US008777649B2

(12) United States Patent
Kao et al.

(10) Patent No.: US 8,777,649 B2
(45) Date of Patent: Jul. 15, 2014

(54) LOCKABLE ELECTRICAL CONNECTOR ASSEMBLIES

(75) Inventors: Selvin Kao, Ladera Ranch, CA (US); Philip Carlo J. DeGuzman, Fontana, CA (US)

(73) Assignee: Standard Cable USA, Inc., Rancho Santa Margarita, CA (US)

( * ) Notice: Subject to any disclaimer, the term of this patent is extended or adjusted under 35 U.S.C. 154(b) by 122 days.

(21) Appl. No.: 13/478,711

(22) Filed: May 23, 2012

(65) Prior Publication Data

US 2013/0316557 A1 Nov. 28, 2013

(51) Int. Cl.
*H01R 13/00* (2006.01)

(52) U.S. Cl.
USPC ..... 439/317

(58) Field of Classification Search
USPC ..... 439/317, 369, 314
See application file for complete search history.

(56) References Cited

U.S. PATENT DOCUMENTS

| | | | | |
|---|---|---|---|---|
| 6,364,681 | B1 * | 4/2002 | Watanabe | 439/335 |
| 6,817,871 | B2 * | 11/2004 | Hedrick et al. | 439/105 |
| 6,957,977 | B1 | 10/2005 | Miller | |
| 2006/0035509 | A1 * | 2/2006 | O'Connor | 439/369 |

* cited by examiner

*Primary Examiner* — Briggitte R Hammond
(74) *Attorney, Agent, or Firm* — Vic Y. Lin; Innovation Capital Law Group, LLP

(57) ABSTRACT

Lockable electrical connector assemblies that couple electrical connectors to prevent the electrical connectors from unintentionally disconnecting are disclosed. The electrical connector assembly has a first electrical connector, a second electrical connector, and a retention ring that has one end surrounding and able to rotate about the second electrical connector. The first electrical connector preferably has tabs that extend away from the first electrical connector. The retention ring has a second end shaped to receive and lock the tabs of the male electrical connector. To form a locked connection, a user rotates the retention ring that causes the retention ring to confine the tabs of the first electrical connector. The user continues to rotate the retention ring until retention ring is placed into a locked position.

12 Claims, 16 Drawing Sheets

LOCKABLE ELECTRICAL CONNECTOR ASSEMBLIES

BACKGROUND OF THE INVENTION

1. Field of the Invention

The present invention relates in general to electrical connectors. More particularly, the invention is directed to lockable electrical connectors.

2. Description of the Related Art

Separable electrical connectors are found in many electrical products such as computer and control systems, power tools, industrial equipment, and consumer products. Conventional electrical connectors are configured to form temporary connections and are easily separable. As a consequence, conventional electrical connectors are prone to unintentional separation during routine use.

Accordingly, a need exists to prevent electrical connectors from separating unintentionally.

SUMMARY OF THE INVENTION

In the first aspect, an electrical connector assembly comprises a first electrical connector having a first housing coupled to a first set of electrical contacts, the housing having one or more tabs extending radially outward from the housing, a second electrical connector having a second housing coupled to a second set of electrical contacts adapted to mate with the first set of electrical contacts, the housing having a generally cylindrical section. The electrical connector assembly further comprises a retention ring having a first section configured for receiving the one or more tabs of the first electrical connector and securing the tabs within the first section, and a second tubular section adapted to surround and rotationally couple to the generally cylindrical section of the second electrical connector.

In a first preferred embodiment of the electrical connector assembly, the first and second electrical connectors are displaced toward each other and locked in place when the retention ring is rotated in a first direction. The first and second electrical connectors are preferably unlocked when the retention ring is rotated in a direction opposite the first direction. The first section preferably further comprises a recessed track formed on the inner surface of the first section, where the recessed track is adapted for receiving and securing the tabs of the first electrical connector when the retention ring is rotated in a first direction. The second housing further comprises a recessed groove formed on a generally cylindrical section, and the second tubular section of the retention ring further comprises a protrusion protruding inward on the inner surface of the second tubular section, the protrusion configured for slidably coupling within the recessed groove of the second electrical connector.

The retention ring preferably further comprises a recessed groove formed on an inner surface of the second tubular section. The second tubular section preferably further comprises a protrusion protruding outward from the outer surface of the generally cylindrical section, where the protrusion is configured for slidably coupling within the recessed groove of the retention ring. The first electrical connector preferably comprises a male connector and the second electrical connector comprises a female connector.

The first electrical connector preferably comprises a female connector and the second electrical connector comprises a male connector.

In a second aspect, an electrical connector assembly comprises a first electrical connector having a first housing coupled to a first set of electrical contacts, the first housing having one or more tabs extending radially away from the housing, and a second electrical connector having a second housing coupled to a second set of electrical contacts adapted to mate with the first set of electrical contacts, the second housing having a recessed groove formed on a generally cylindrical section. The electrical connector assembly further comprises a retention ring having a first section configured for receiving the one or more tabs of the first connector and securing the tabs within the first section, and a second tubular section adapted to surround the generally cylindrical section of the second electrical connector, the second tubular section having a protrusion protruding inward on the inner surface of the second tubular section, the protrusion configured for slidably coupling within the recessed groove of the second electrical connector.

In a second preferred embodiment, the first and second electrical connectors are displaced toward and locked in place with the other electrical connector when the retention ring is rotated in a first direction. The first section preferably further comprises a recessed track formed on the inner surface of the retention ring, where the recessed track is adapted for receiving and securing the tab of the first electrical connector when the retention ring is rotated in a first direction.

The recessed groove of the retention ring preferably further comprises a locked region having a length essentially perpendicular to an insertion direction, the locked region located at a first distance from the outermost surface of the generally cylindrical section, an unlocked region having a length essentially perpendicular to an insertion direction, the unlocked region located at a second distance from the outermost surface of the generally cylindrical section, the second distance differing from the first distance, and an angled region providing a continuous path between the locked region and the unlocked region. The first electrical connector preferably comprises a male connector and the second electrical connector comprises a female connector. The first electrical connector preferably comprises a female connector and the second electrical connector comprises a male connector.

In a third aspect, an electrical connector assembly comprises a first electrical connector having a first housing coupled to a first set of electrical contacts, the housing having one or more tabs extending radially away from the housing, a second electrical connector having a second housing coupled to a second set of electrical contacts adapted to mate with the first set of electrical contacts, the second housing having a generally cylindrical section and a protrusion protruding outward from the generally cylindrical section. The electrical connector assembly further comprises a retention ring having a first section configured for receiving the one or more tabs of the first connector and securing the tabs within the first section, and a second tubular section adapted to surround and rotate about the generally cylindrical section of the second electrical connector, the retention ring further comprises a recessed groove formed on inner surface of the second tubular section. The protrusion is configured for slidably coupling within the recessed groove of the retention ring.

In a third preferred embodiment, the first and second electrical connectors are displaced toward and locked in place with the other electrical connector when the retention ring is rotated in a first direction. The first section preferably further comprises a recessed track formed on the inner surface of the retention ring, where the recessed track is adapted for securing the tab of the first electrical connector when the retention ring is rotated in a first direction.

The recessed groove of the retention ring preferably further comprises a locked region having a length essentially perpendicular to an insertion direction, the locked region located at a first distance from the outermost surface of the generally cylindrical section, an unlocked region having a length essentially perpendicular to an insertion direction, the unlocked region located at a second distance from the outermost surface of the generally cylindrical section, the second distance differing from the first distance, and an angled region providing a continuous path between the locked region and the unlocked region. The first electrical connector preferably comprises a male connector and the second electrical connector comprises a female connector. The first electrical connector preferably comprises a female connector and the second electrical connector comprises a male connector.

Various embodiments of tabs, or ears, are also provided which may be formed on either the male or female connector. It is to be expressly understood that corresponding grooves in the retention ring must be conformed so as to receive the differently configured tabs.

These and other features and advantages of the invention will become more apparent with a description of preferred embodiments in reference to the associated drawings.

DETAILED DESCRIPTION OF THE PREFERRED EMBODIMENTS

The following preferred embodiments are directed to lockable electrical connector assemblies. Lockable electrical connector assemblies secure female and male electrical connectors and prevent the electrical connectors from unintentionally disconnecting as a result of tension applied to the connector assemblies. Such lockable assemblies may be employed in numerous consumer and industrial applications.

Within this disclosure, reference is made to standard 120 volt North American grounded plugs such as NEMA 5 connectors which are used as specific examples of a preferred implementation. This, however, should not be taken as being limiting in nature as other electrical connectors including, but not limited to, other NEMA devices, electrical connectors standard in other countries, and other forms of electrical connections are contemplated in one or embodiments. Moreover, reference is made to separate electrical connectors each attached to a power cord are used as specific examples of preferred implementations. This, however, should not be taken as being limiting in nature as other electrical connectors such as wall mounted devices are contemplated in embodiments.

The electrical connector assembly has a first electrical connector, a second electrical connector, and a retention ring that has one end surrounding and able to rotate about the second electrical connector. In an embodiment, the first electrical connector is a male electrical connector (i.e., a male plug), and the second electrical connector is a female electrical connector (i.e., a female receptacle). The male electrical connector preferably has tabs, or ears, that extend radially away from the connector. The retention ring has a second end shaped to receive and lock the tabs of the male electrical connector.

To form a locked connection, a user plugs the prongs of the male electrical connector into the sockets of the female electrical connector. The user then rotates the retention ring which causes the retention ring to confine the tabs of the male electrical connector. The user continues to rotate the retention ring until the retention ring is placed into a locked position. The user rotates the retention ring about the electrical connectors less than 180 degrees. To unlock the electrical connection, the user rotates the retention ring in the opposite direction, and then unplugs the male electrical connection from the female electrical connection.

Figure 1:
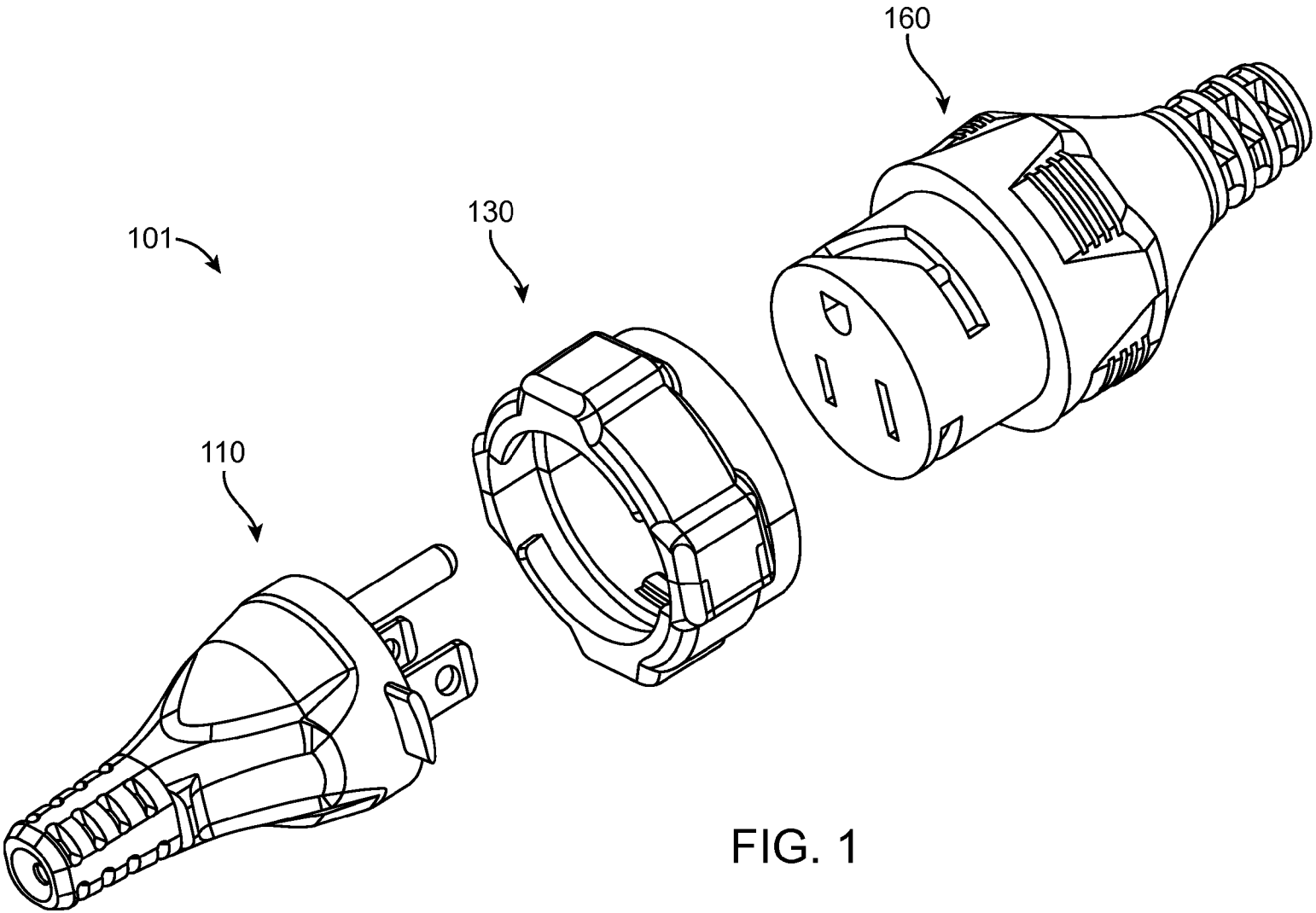
FIG. 1 is a top, exploded view of a first preferred embodiment of a lockable electrical connector assembly.
Figure 2:
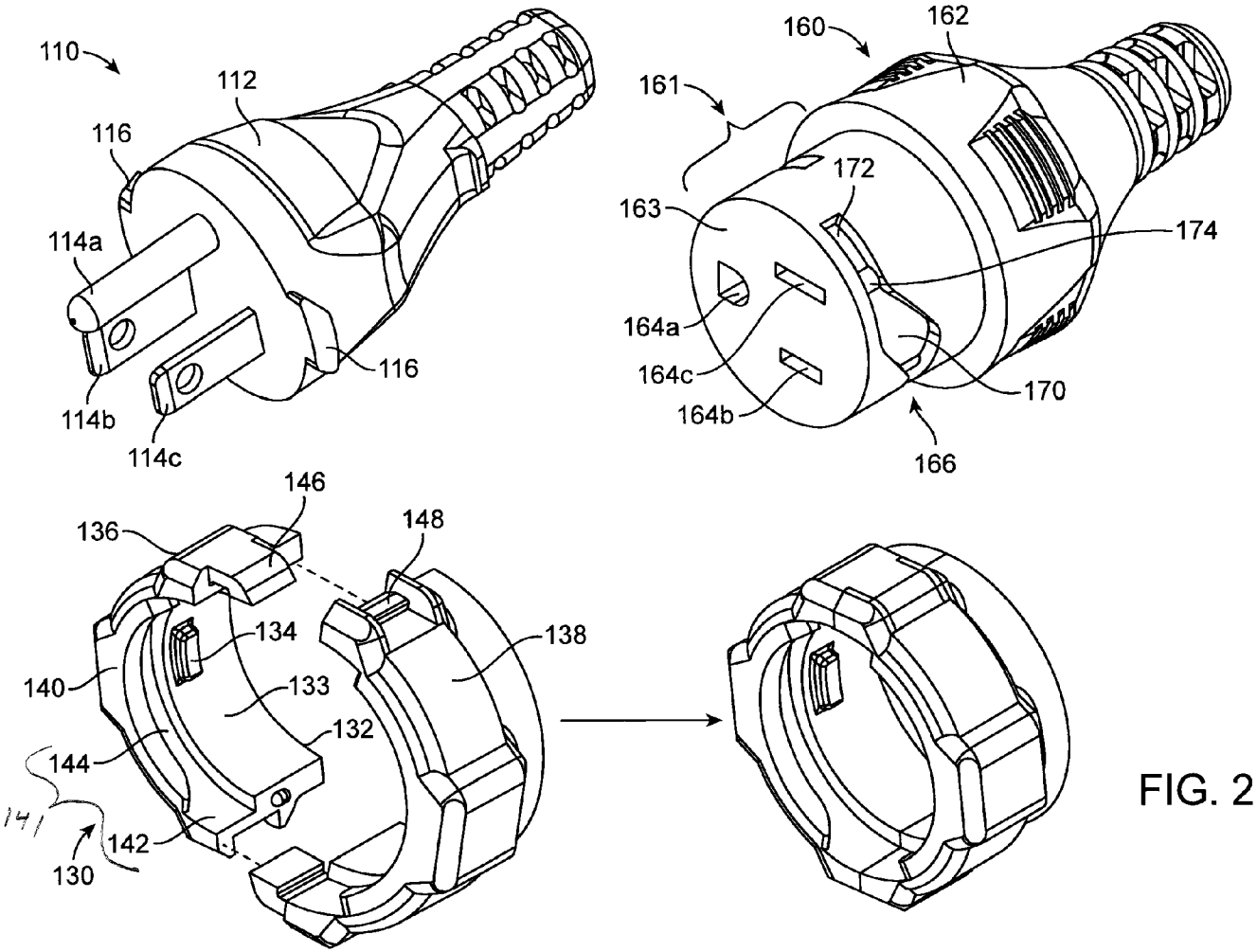
FIG. 2 depicts perspective views of the male electrical connector, the female electrical connector, and a retention ring of the first preferred embodiment of the lockable electrical connector assembly.

FIG. 1 is a top, exploded view of a first preferred embodiment of a lockable electrical connector assembly 101. The connector assembly 101 comprises a male electrical connector 110 and a female electrical connector 160. A retention ring 130 is employed to couple the male electrical connector 110 and the female electrical connector 160. FIG. 2 provides additional details regarding the components of the connector assembly 101. The male electrical connector 110 has male electrical contacts 114*a*-114*c* axially emerging away from the male housing 112. The male electrical connector 110 has one or more tabs 116 that extend radially outward from the male housing 112. In an embodiment, the male electrical connector 110 has two tabs extending radially outward from the male housing 112. The tabs 116 extend perpendicular to the insertion direction (i.e., the direction defined by the length of the electrical prongs).

The female electrical connector 160 has a housing 162 that receives the female electrical contacts 164*a-c* generally orthogonal to the front face 163. The housing 162 has a generally cylindrical section 161 that has one or more recessed grooves 166 which is discussed in greater detail below.

The retention ring 130 comprises a first half, or first body, 136 and a second half, or second body, 138 that snap together via the clips 146 engaging with the notches 148 during assembly. The retention ring 130 has a first, or front, section 140 that has at least one pathway 141 comprising a receiving recesses 142 adapted to receive the tabs 116 of the male electrical connector 110 and a recessed track 144 on the inner surface of the retention ring 130 that secures the tabs 116 when the retention ring 130 is rotated. In the preferred embodiment, the assembly 101 preferably comprises a pair of tabs 116 on the male connector 110 that interact with a pair of pathways 141 defined in the retention ring 130.

The retention ring 130 has a second, or rear, tubular section 132 having an inner cylindrical surface 133 that is adapted to surround and rotate about the generally cylindrical section 161 of the female electrical connector 160. A protrusion 134 is formed on the inner surface 133 and is shaped to fit within and slidably couple within the recessed groove 166 of the female electrical connector.

Figure 3:
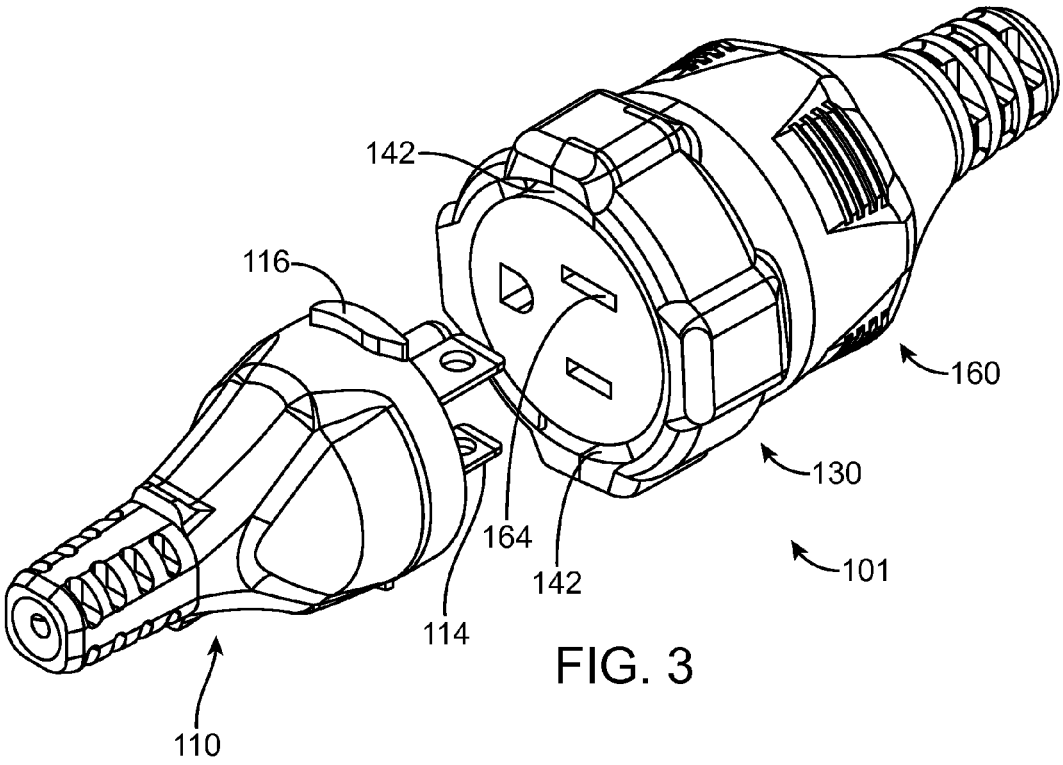
FIG. 3 is top, perspective view of the first preferred embodiment of the lockable electrical connector assembly in the process of mating.
Figure 4:
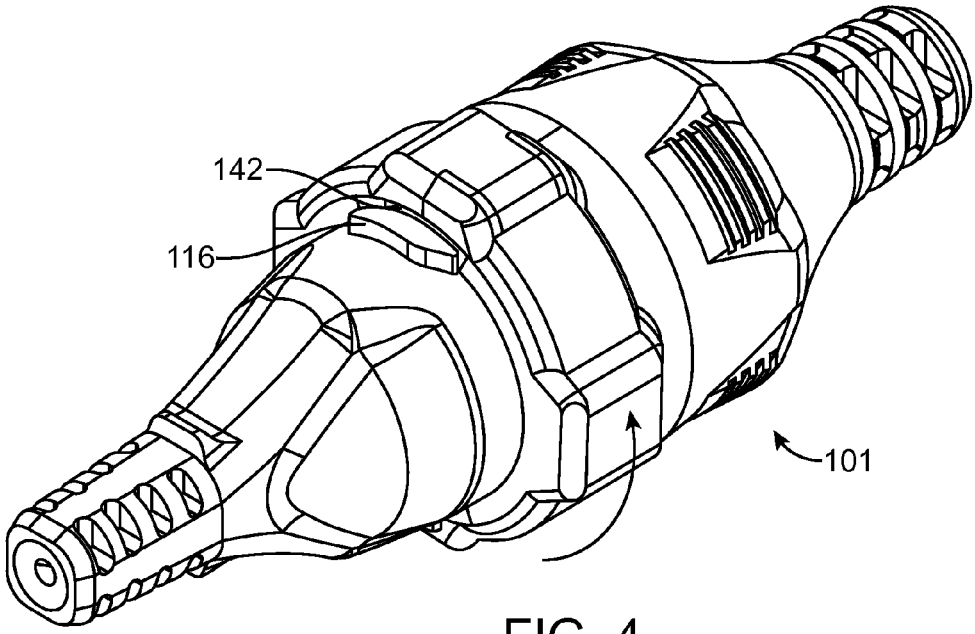
FIG. 4 is an assembled, perspective view of the mated lockable electrical connectors.

FIG. 3 is top, perspective view of the first preferred embodiment of the lockable electrical connector assembly 101. The retention ring 130 surrounds and rotates about the generally cylindrical section 161 of the female electrical connector 160. A user initially rotates the retention ring 130 such that the receiving recesses 142 align with the tabs 116 of the male electrical connector 110. As depicted in FIG. 4, the user plugs the male electrical connector 110 into the female electrical connector 160 such that the receiving recesses 142 receive the tabs 116 of the male electrical connector 110. The retention ring 130 is then rotated to lock the male electrical connector 110 to the female electrical connector 160.

Figure 5:
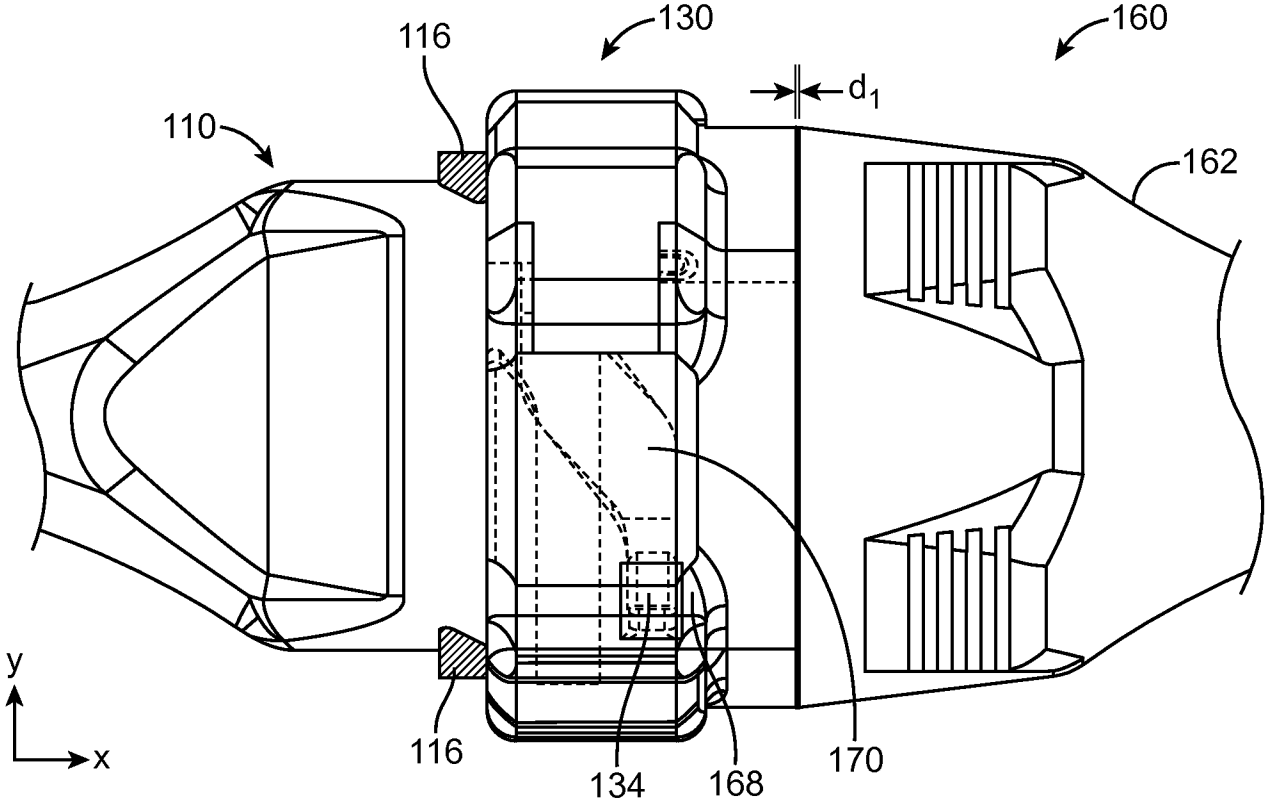
FIG. 5 is a top view of the electrical connector assembly with a cutaway view of the retention ring initially receiving the tabs of the male electrical connector.
Figure 6:
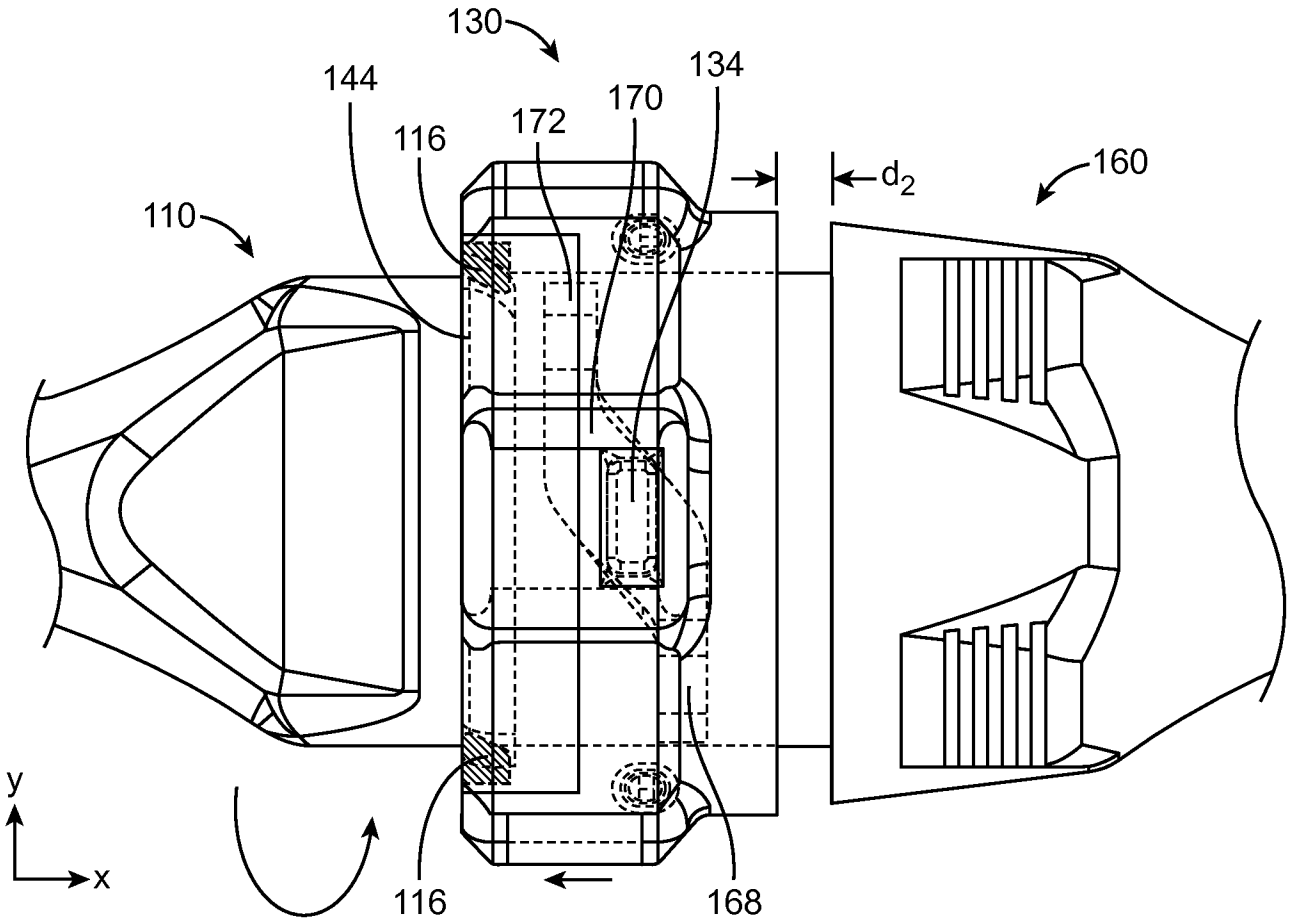
FIG. 6 is a top view of the electrical connector assembly with a cutaway view of the retention ring securing the tabs of the male electrical connector.
Figure 7:
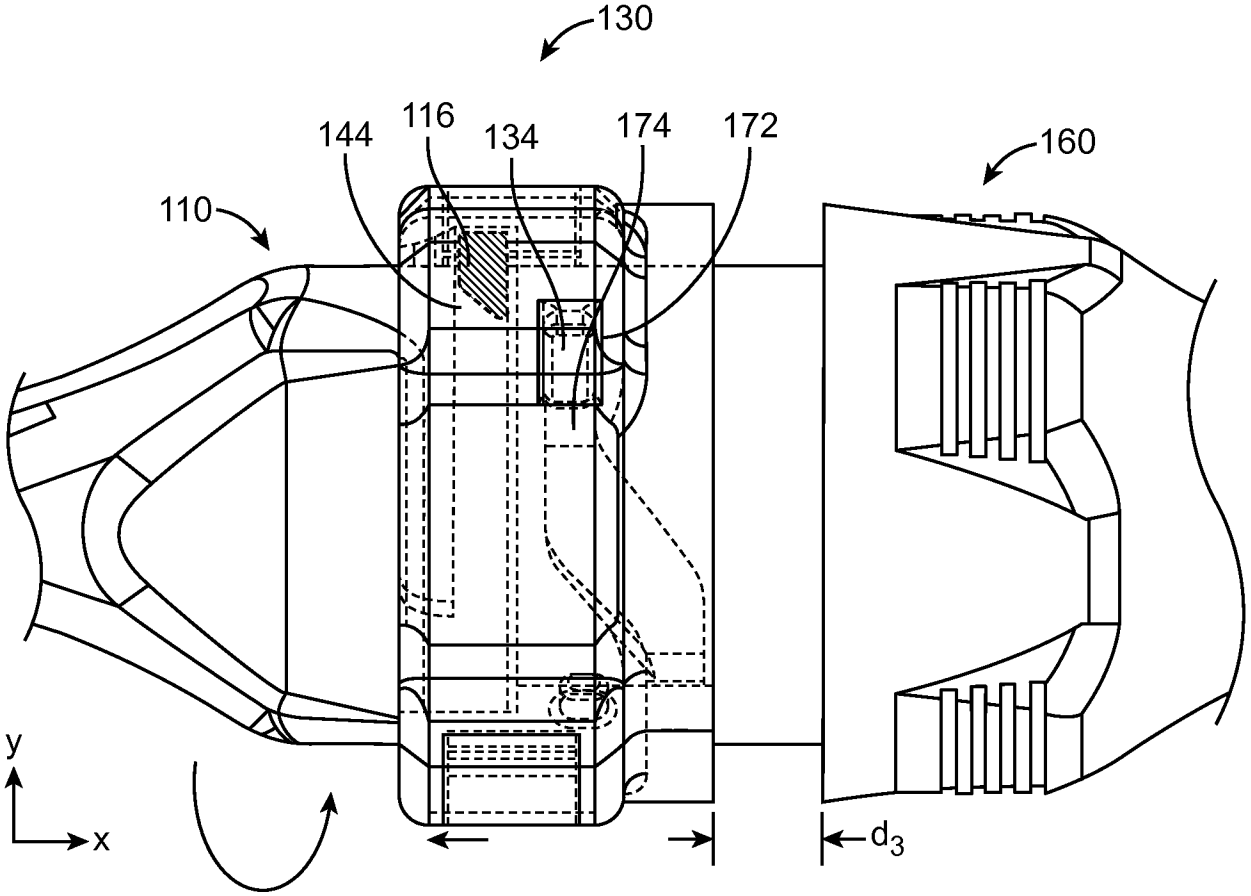
FIG. 7 is a top view of the electrical connector assembly with a cutaway view of the retention ring locking the tabs of the male electrical connector.

The retention ring 130 is configured to pull or draw the male electrical connector 110 towards the female electrical connector 160 during rotation. As depicted in FIGS. 5-7, the recessed groove 166 has a multi-angled path comprising a locked region 172, an angled region 170, and an unlocked region 168. The locked region 172 and the unlocked region 170 are generally located parallel with the circumference of the generally cylindrical region 161. The locked region 172 has a length essentially perpendicular to an insertion direction (i.e., the insertion direction parallel with the x-axis as shown in FIG. 5), the locked region located at a first distance from the front face 163 of the generally cylindrical section 161. The unlocked region 168 has a length essentially perpendicular to an insertion direction and is located at a second distance from the front face 163 of the generally cylindrical section 161, the second distance differing from the first distance. The angled region 168 provides a continuous, diagonal path between the locked region 172 and the unlocked region 168. A raised rib 174 is located between the locked region 172 and the angled region 170.

As a result of the multi-angled path of the recessed groove 166, the protrusion 134 being confined within the recessed groove 166, will traverse a helical, spiral path when the retention ring 130 is rotated. As a result, the male electrical connector 110 and the female electrical connector 160 are linearly displaced toward each other parallel to the x-axis and locked in place when the retention ring 130 is rotated in a first direction (i.e., upward in FIGS. 5-7) parallel with the y-axis. Likewise, the male electrical connector 110 and the female electrical connector 160 are linearly displaced away from each other parallel to the x-axis and unlocked when the retention ring 130 is rotated in a direction opposite the first direction (i.e., downward). Embodiments of the electrical connector assemblies are configured for locking with a simple, twist motion having a rotation of less than 180 degrees.

FIG. 5 shows the male electrical connector 110 plugged into the female electrical connector 160. The protrusion 134 on the inner surface 133 of the retention ring 130 is located in the unlocked region 168 of the recessed groove 166 of the female electrical connector 160. The distance $d_1$ between the retention ring 130 and the housing 162 is at a minimum distance while the protrusion 134 is located in the unlocked region 168. The retention ring 130 and the housing 162 may be essentially in contact. The tabs 116 of the male electrical connector 110 are adjacent to the receiving recesses 142 of the retention ring 130.

FIG. 6 is a top, cutaway view of the electrical connector assembly as the assembly is locking. As discussed above, the locked region 172 and the unlocked region 168 are offset with respect to each other, such that the angled region 170 is oriented having an angle with respect to the circumference or the y-axis in this example. Consequently, as the retention ring 130 is rotated upward parallel with the y axis, the protrusion 134 will follow the path defined by the angled region 170 that will slide the retention ring 130 away in a direction parallel with the negative x-axis from the female housing 162 and toward the male electrical connector 110. The distance $d_2$ between the retention ring 130 and the housing 162 increases as the retention ring 130 is moved into locking position. Simultaneously, as retention ring 130 is rotated upward, the tabs 116 are entering the recessed track 144 which receives and secures the tabs 116 from detaching from the retention ring 130.

FIG. 7 is a top, cutaway view of the electrical connector assembly when the assembly is locked. The protrusion 134 is in the locked region 172 and the tabs 116 have fully entered the recessed track 144 of the retention ring 130. The raised rib 174 separates the locked region 172 from the angled region 170 and prevents the protrusion 134 from unintentionally slipping into the angled region 170. The distance $d_3$ between the retention ring 130 and the housing 162 is at the maximum when the retention ring 130 is locked. In the preferred embodiment, the assembly 101 preferably comprises a pair of protrusions 134 which interact with a pair of grooves 166 formed in the female electrical connector 160.

Figure 8:
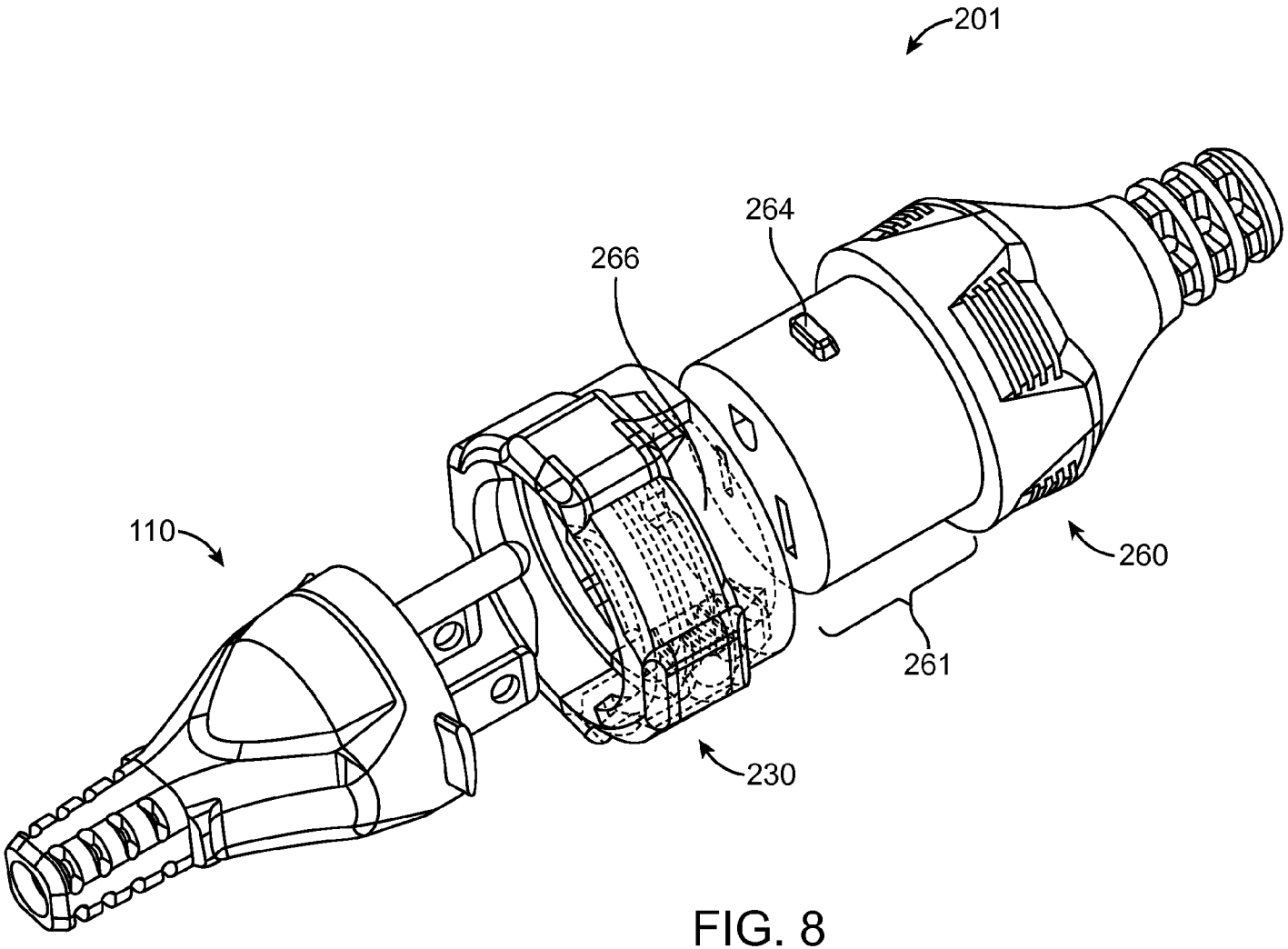
FIG. 8 is a top, cutaway exploded view of a second preferred embodiment of a lockable electrical connector assembly.

FIG. 8 is a top, cutaway exploded view of a second preferred embodiment of a lockable electrical connector assembly 201 where the mating arrangement between the retention ring and the female electrical connector has been reversed from that of the first preferred assembly. In the second preferred embodiment, at least one protrusion 264 is formed on the generally cylindrical section 261 of a female electrical connector 260 while the corresponding groove is formed on the retention ring 230. Other structural features of electrical connector assembly 201 may be generally similar to those stated above with respect to electrical connector assembly 101.

Figure 9:
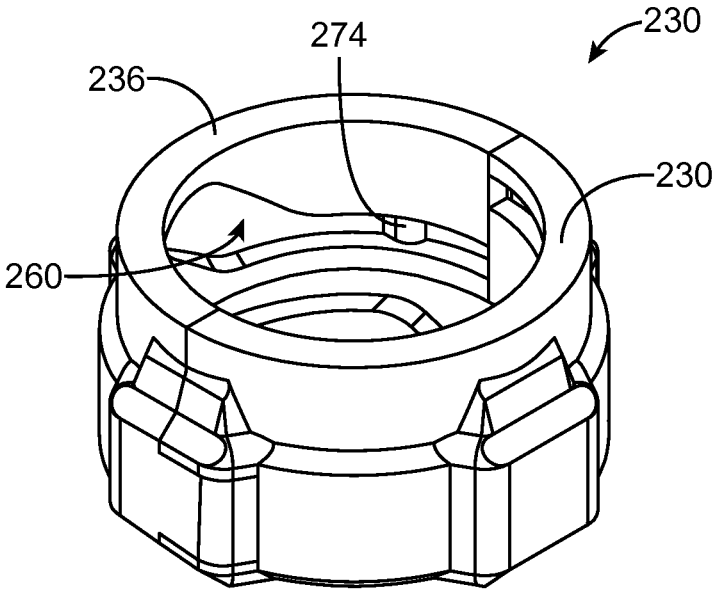
FIG. 9 is a top, perspective view of the retention ring of the second preferred embodiment.
Figure 10:
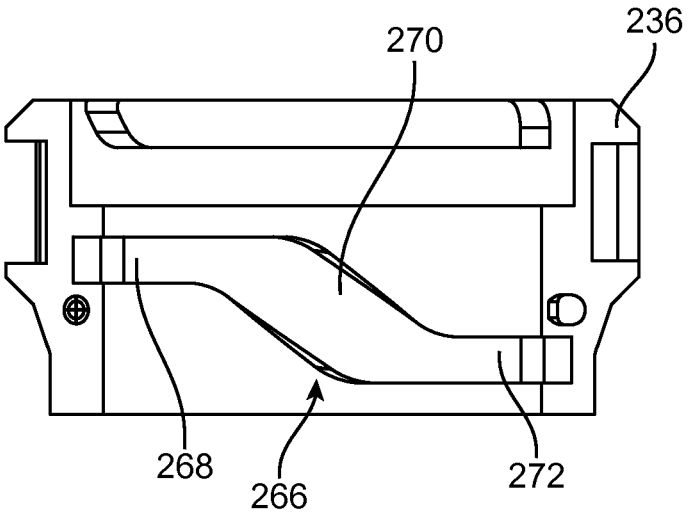
FIG. 10 is a top view of the inner surface of the retention ring showing the recessed groove in the second preferred embodiment.

As depicted in FIGS. 9 and 10, the retention ring 230 has one or more recessed grooves 266 with a locked region 272, an angled region 270, and an unlocked region 268. The locked region 272 and the unlocked region 270 are generally located along the inner surface of the retention ring 230. The locked region 272 has a length essentially perpendicular to an insertion direction, the locked region located at a first distance from the outermost surface of the retention ring 230. The unlocked region 268 has a length essentially perpendicular to an insertion direction and is located at a second distance from the outermost surface of the retention ring 230, the second distance differing from the first distance. The angled region 270 provides a continuous, diagonal path between the locked region 272 and the unlocked region 268. A raised rib 274 is located between the locked region 272 and the angled region 270 that prevents the retention ring 230 from unintentionally unlocking. As a result of the diagonal path of the recessed groove 266, the protrusion 264 that protrudes outward from the generally cylindrical section 261 will traverse a helical, spiral path when a user rotates the retention ring 230.

Figure 11:
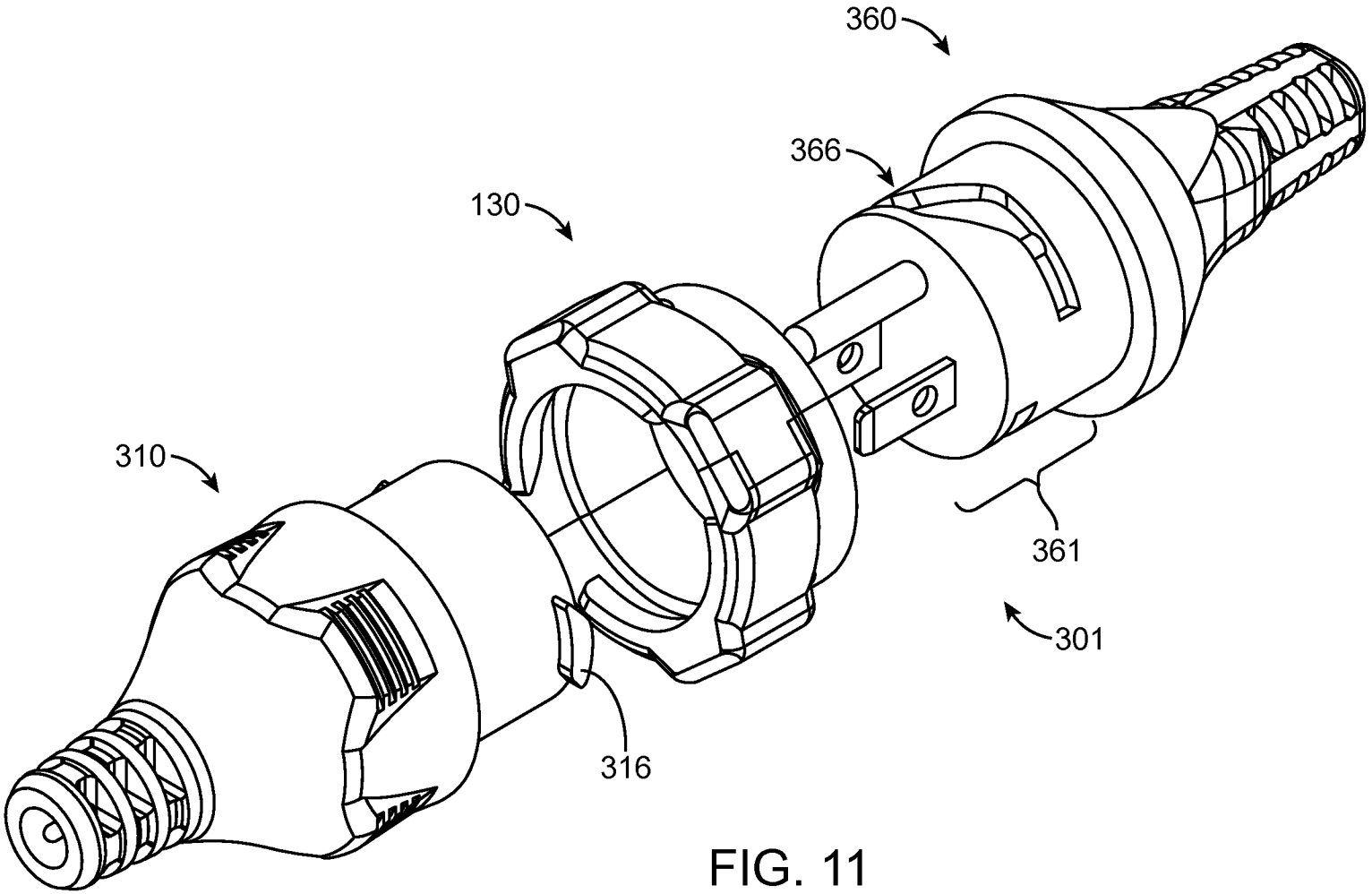
FIG. 11 is a top, exploded view of a third preferred embodiment of an electrical connector assembly.

FIG. 11 is a top, perspective view of electrical connector assembly 301 of a third preferred embodiment. The features of electrical connector assembly 301 may be generally similar to those stated above with respect to electrical connector assembly 101. Electrical connector assembly 301 comprises a female electrical connector 310 having tabs 316 extending radially outward. The male electrical connector 360 has a generally cylindrical section 361 that has one or more recessed grooves 366 that may be shaped similar to that of recessed groove 166 as depicted in FIG. 2 and discussed above. Retention ring 130 has a protrusion 134 formed on the inner surface 133 and is shaped to fit and slidably couple within the recessed groove 366 of the female electrical connector.

Figure 12:
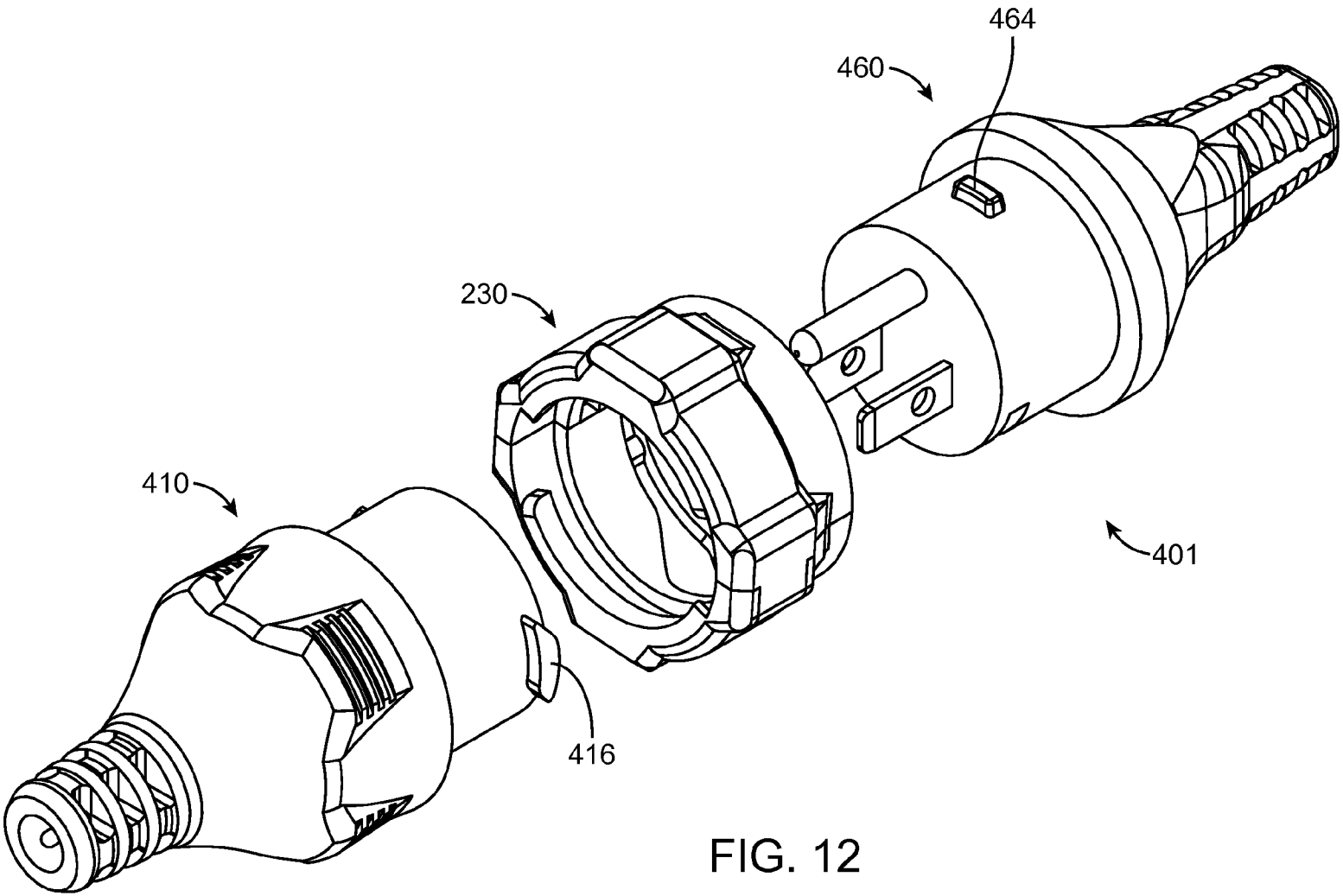
FIG. 12 is a top, exploded view of a fourth preferred embodiment of an electrical connector assembly.

FIG. 12 is a top, perspective view of electrical connector assembly 401 of a fourth preferred embodiment. The features of electrical connector assembly 201 may be generally similar to those stated above with respect to electrical connector assembly 201. Electrical connector assembly 401 comprises a female electrical connector 410 having tabs 416 extending radially outward. The male electrical connector 460 has a generally cylindrical section that has a protrusion 464 similar to that of protrusion 264 depicted in FIG. 8. Retention ring 230 (discussed above) similarly couples to the male electrical connector as discussed above and shown in FIGS. 8-10.

In the foregoing embodiments, it will be appreciated that the retention ring in each preferred assembly has two interfaces: a first interface with the male electrical connector and a second interface with the female electrical connector. A protrusion and corresponding groove is formed at either one of the two interfaces while a tab and corresponding track is formed at the other interface.

In the foregoing embodiments, it will also be appreciated that the tabs, or ears, may be formed on the male connector, as in the first and second preferred embodiments of the assembly, or on the female connector, as in the third and fourth preferred embodiments. Accordingly, FIGS. 13-18 illustrate different embodiments of tabs, or ears, which may be formed on either the male or female connector in order to interact with the retention ring. It will be appreciated that the corresponding groove formed in the retention ring will be conformed so as to receive these tabs and facilitate a secure fit in the locked position.

Figure 13:
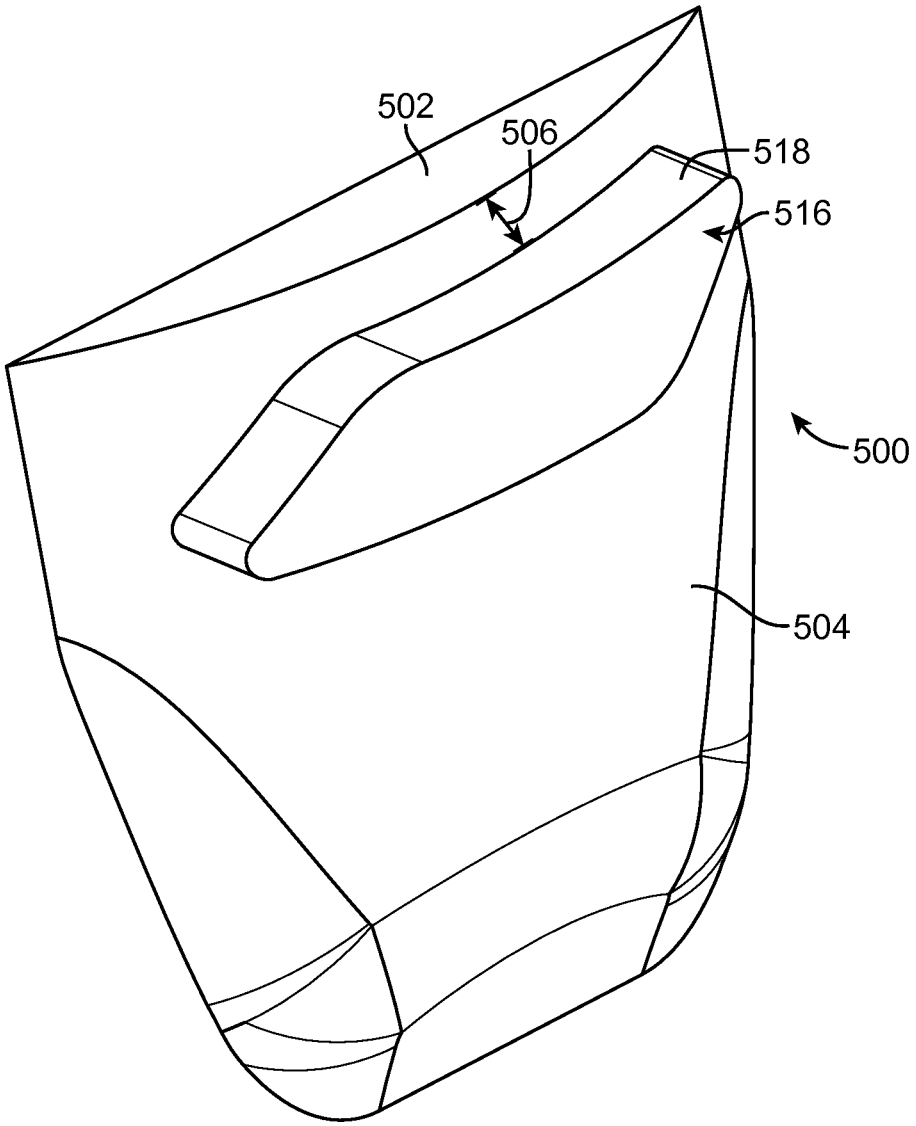
FIG. 13 is a perspective view of an alternative embodiment of an indented tab which may be formed on either a male or female connector.

FIG. 13 illustrates an alternative embodiment of a tab 516 which extends radially from a connector 500, which may be either male or female. As depicted throughout FIGS. 13-18, the connector 500 comprises a generic male or female connector having an end surface 502 and a generally cylindrical sidewall 504. In FIG. 13, the tab 516 comprises a parallelogram shape including a distal surface 506 that is preferably recessed or indented back a distance 520 from the connector end surface 502.

Figure 14:
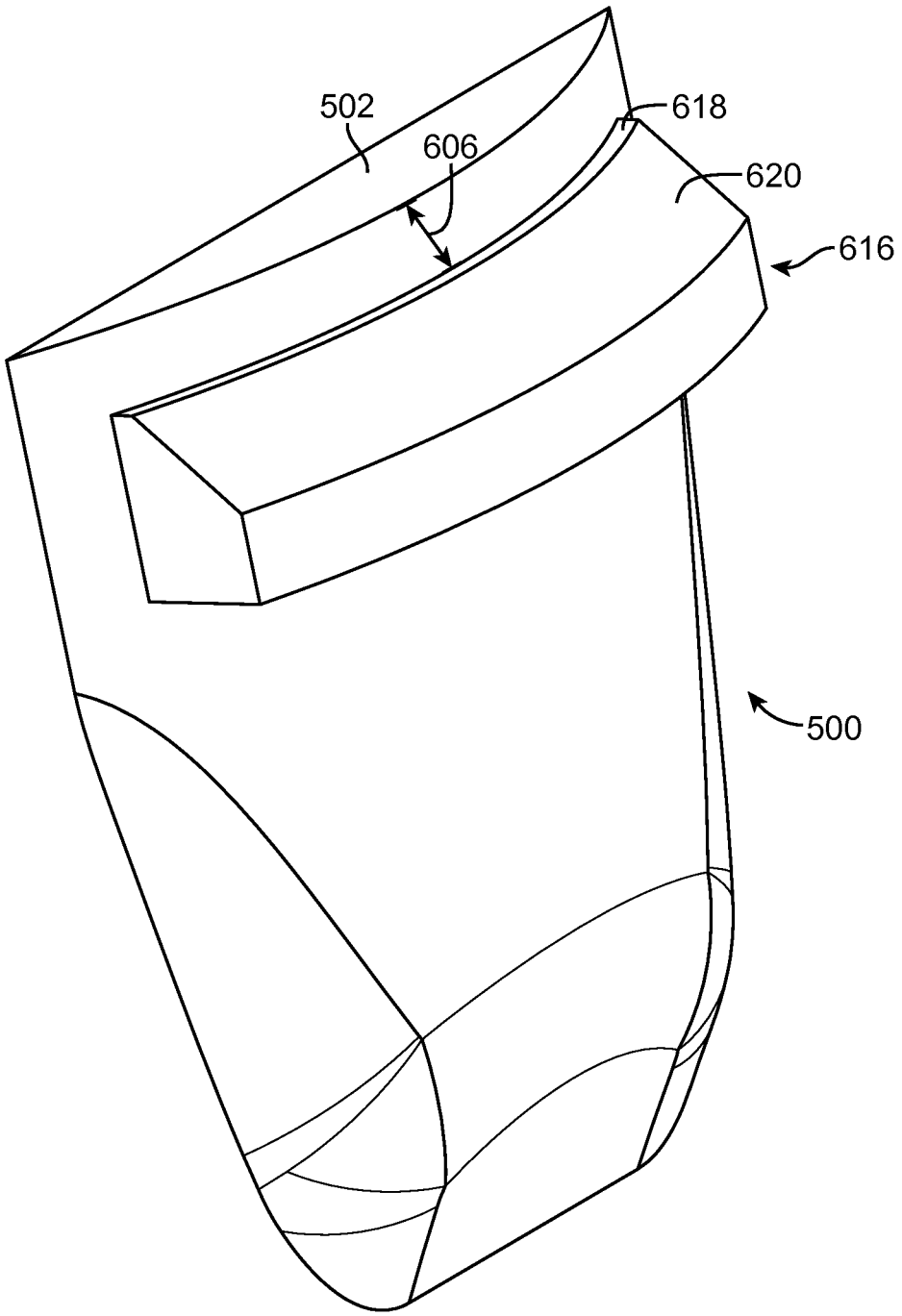
FIG. 14 is a perspective view of a further alternative embodiment of an indented tab which may be formed on either a male or female connector.

FIG. 14 illustrates a further alternative embodiment of an indented tab 616 formed on a generic connector 500 and having a tapered edge 620 that protrudes radially as it extends from the connector end surface 502. In FIG. 14, the tapered edge 620 includes a distal surface 618 spaced a distance apart 606 apart from the connector end surface 502.

Figure 15:
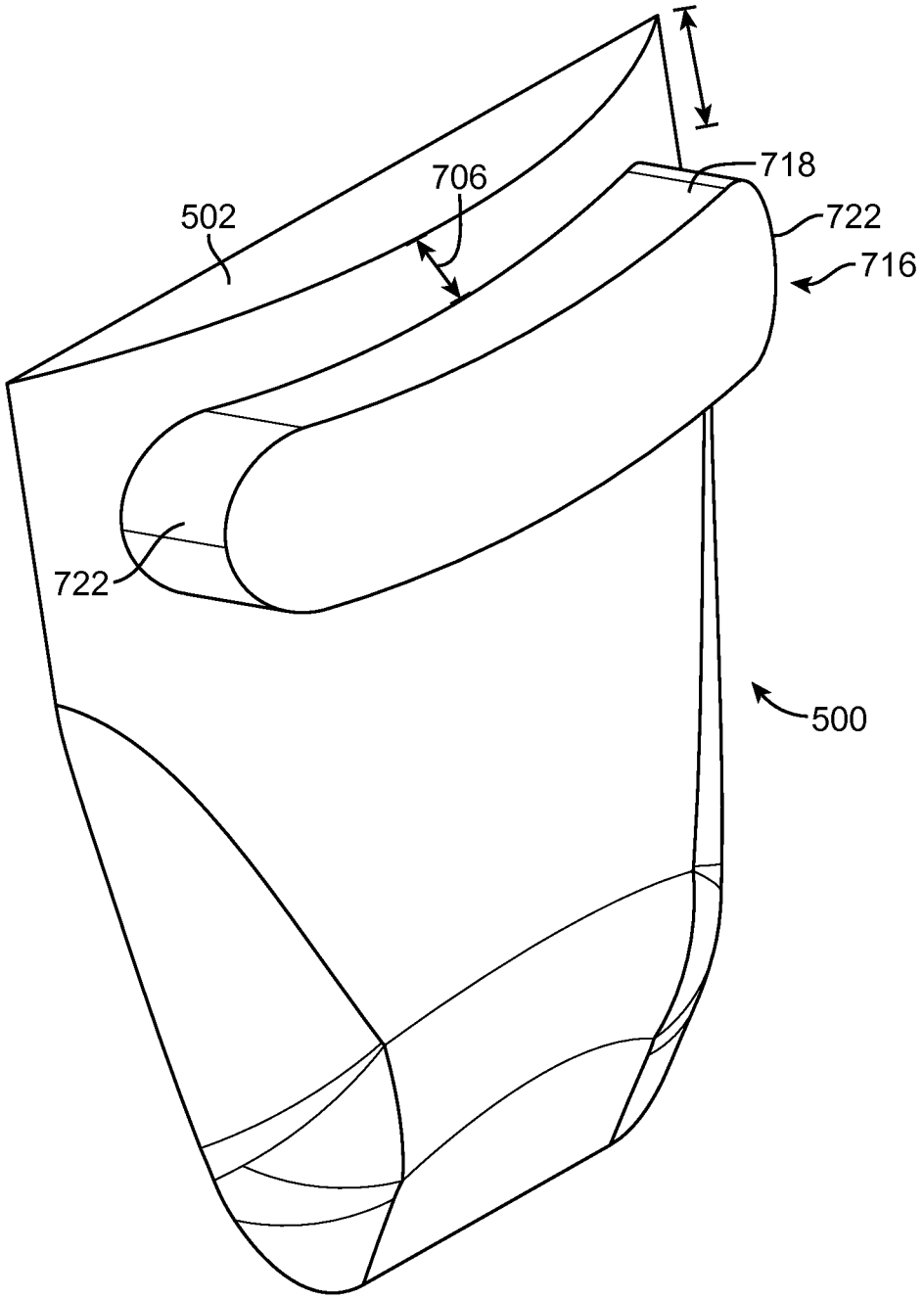
FIG. 15 is a perspective view of a further alternative embodiment of an indented tab which may be formed on either a male or female connector.

FIG. 15 illustrates a further alternative embodiment of an indented tab 716 formed on a generic connector 500 and having a distal surface 718 spaced a distance 706 apart from the end connector surface 502. A pair of rounded corners 722 are formed at opposite sides of the tab 716.

Figure 16:
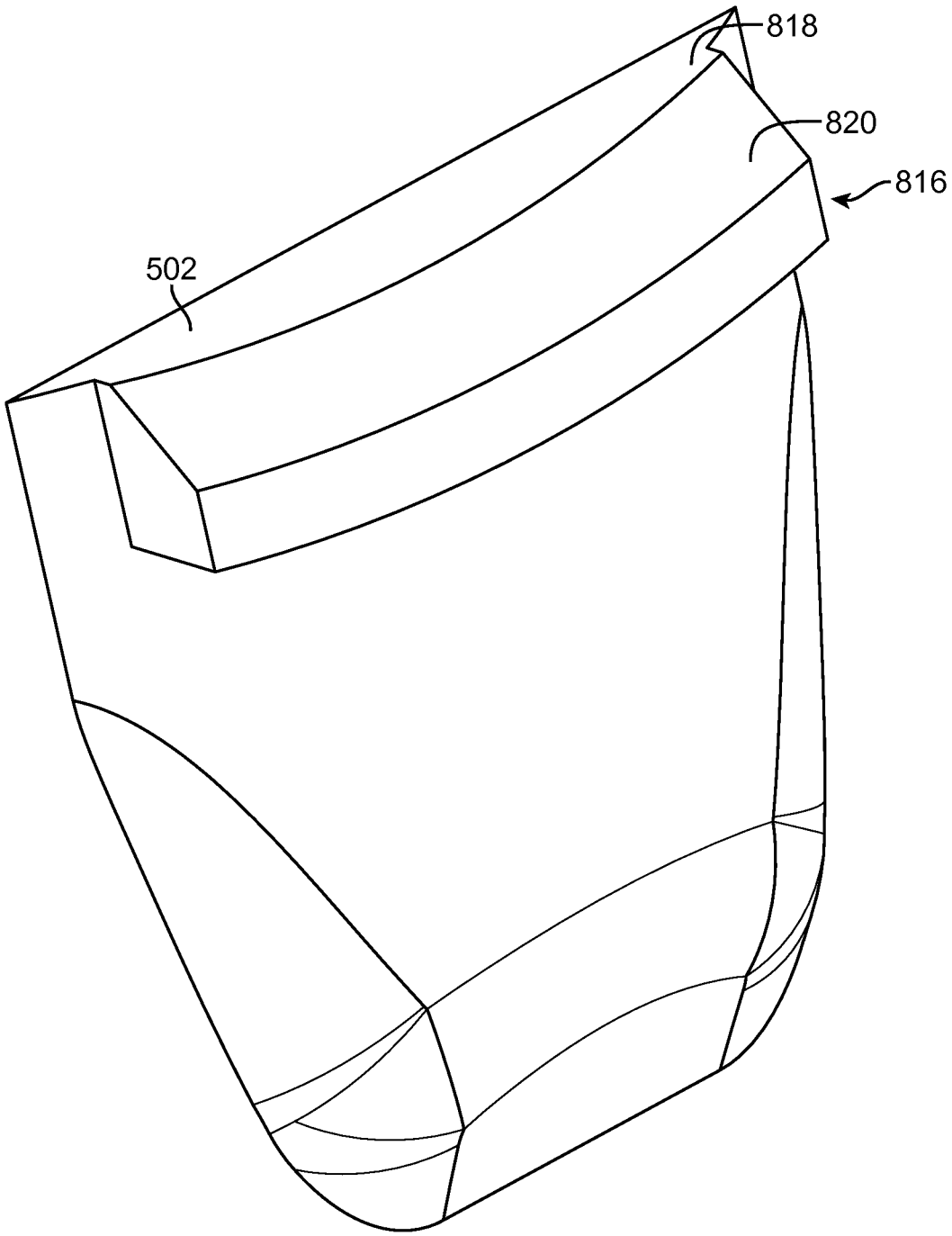
FIG. 16 is a perspective view of a further alternative embodiment of a flush tab which may be formed on either a male or female connector.

FIG. 16 illustrates a further alternative embodiment of a tapered tab 816 with a structure similar to that of the tapered tab 616 shown in FIG. 14, except that this embodiment has a distal tab surface 818 that is flush with the connector end surface 502. In FIG. 16, the tapered edge 820 protrudes radially as it extends from the connector end surface 502.

Figure 17:
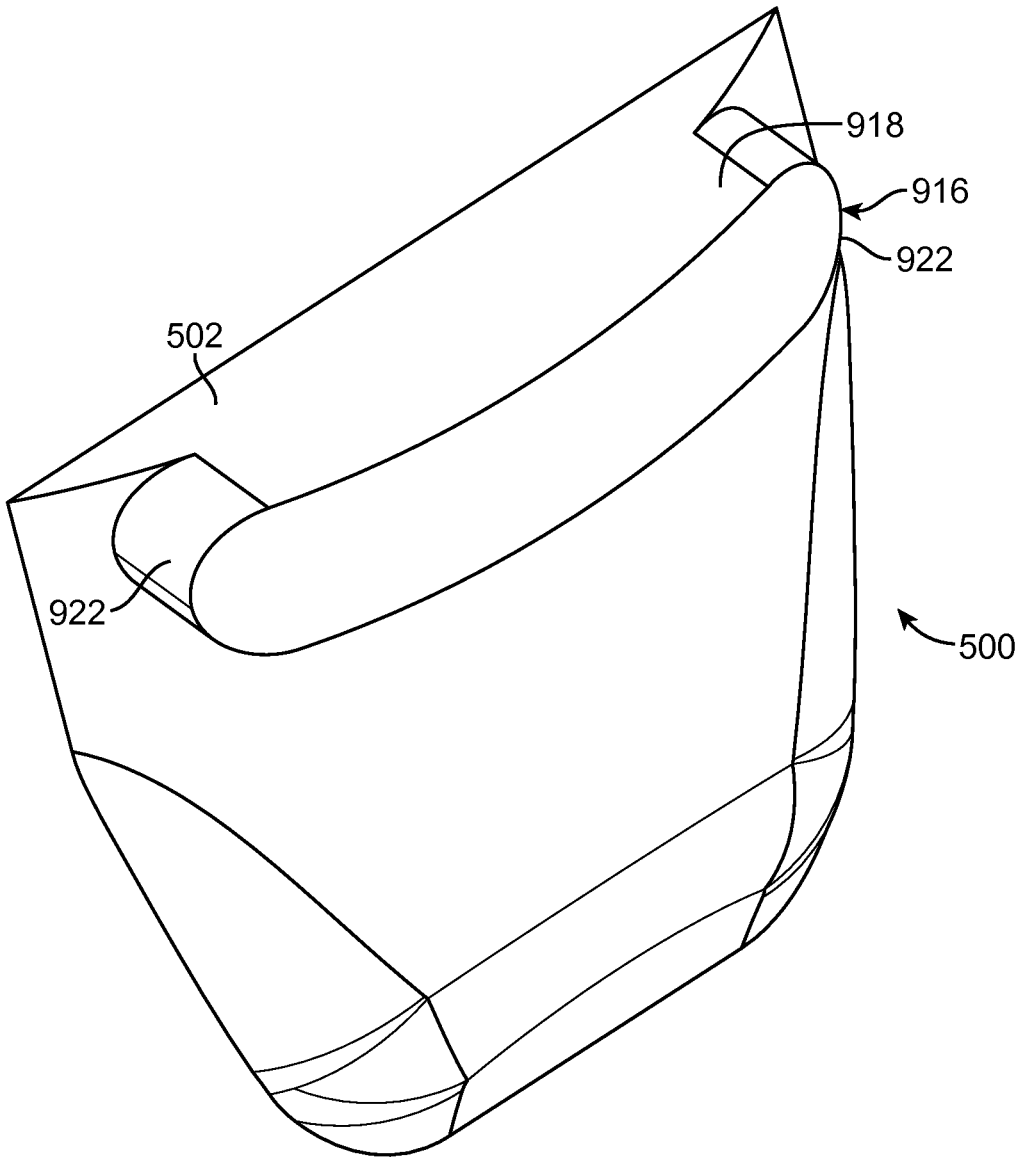
FIG. 17 is a perspective view of a further alternative embodiment of a flush tab which may be formed on either a male or female connector.

FIG. 17 illustrates a further alternative embodiment of a rounded tab 916 with a structure similar to that of the rounded tab 716 shown in FIG. 15, except that this embodiment has a distal tab surface 918 that is flush with the connector end surface 502. In FIG. 16, the tapered edge 820 protrudes radially as it extends from the connector end surface 502. A pair of rounded corners 922 are formed at opposite sides of the tab 916.

Figure 18:
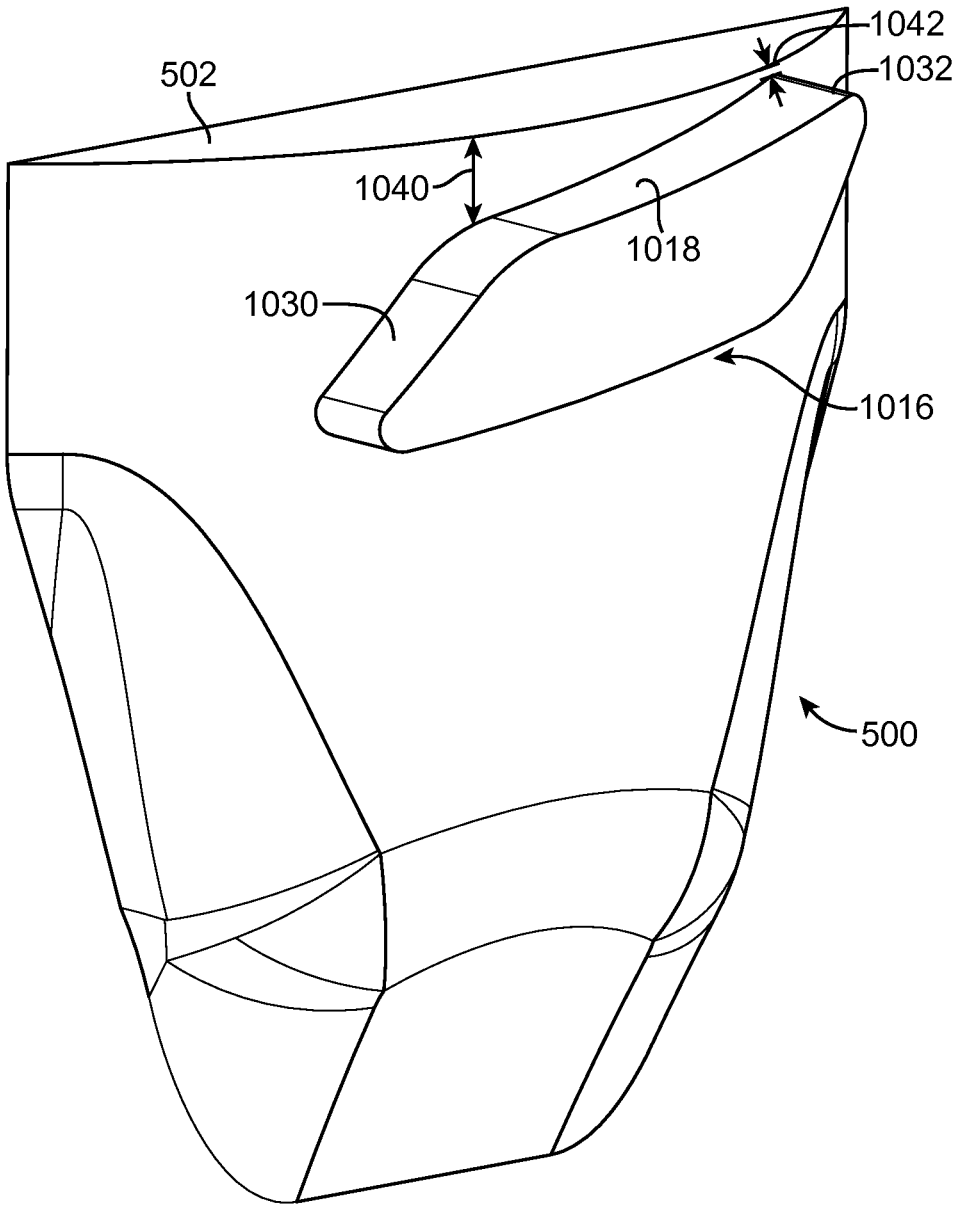
FIG. 18 is a perspective view of a further alternative embodiment of a flush tab which may be formed on either a male or female connector.

FIG. 18 illustrates an alternative embodiment of a parallelogram tab 1016 which is formed around the connector 500 at an angled orientation with respect to the end connector surface 502. In particular, the tab 1016 comprises a distal surface 1018 having a leading portion 1030 which is spaced farther distance 1040 apart from the end connector surface than a trailing portion 1032 which spaced a shorter distance 1042 from the end connector surface 502. In FIG. 13, the tab 516 comprises a parallelogram shape including a distal surface 506 that is preferably recessed or indented back a distance 520 from the connector end surface 502.

Although the invention has been discussed with reference to specific embodiments, it is apparent and should be understood that the concept can be otherwise embodied to achieve the advantages discussed. The preferred embodiments above have been described primarily as lockable electrical connectors employing a retention ring that locks the connectors as a result of a simple twist. Preferred embodiments employ a protrusion confined within a groove having diagonal portion that imparts a linear displacement on the electrical connectors when the retention ring is rotated. In this regard, the foregoing description of the lockable electrical connectors is presented for purposes of illustration and description. Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An electrical connector assembly comprising:

a first electrical connector having a first housing coupled to a first set of electrical contacts, the housing having one or more tabs extending radially outward from the housing;

a second electrical connector having a second housing coupled to a second set of electrical contacts adapted to mate with the first set of electrical contacts, the housing having a generally cylindrical section; and, a retention ring having a first section configured for receiving the one or more tabs of the first electrical connector and securing the tabs within the first section, and a second tubular section adapted to surround and rotationally couple to the generally cylindrical section of the second electrical connector, wherein:

the second housing further comprises a recessed groove formed on a generally cylindrical section; and, the second tubular section of the retention ring further comprises a protrusion protruding inward on the inner surface of the second tubular section, the protrusion configured for slidably coupling within the recessed groove of the second electrical connector.

2. An electrical connector assembly of claim 1, wherein the first section further comprises a recessed track formed on the inner surface of the first section, wherein the recessed track is adapted for receiving and securing the tabs of the first electrical connector when the retention ring is rotated in a first direction.

3. An electrical connector assembly of claim 1, wherein the first electrical connector comprises a male connector and the second electrical connector comprises a female connector.

4. An electrical connector assembly of claim 1, wherein the first electrical connector comprises a female connector and the second electrical connector comprises a male connector.

5. An electrical connector assembly of claim 1, wherein the first and second electrical connectors are displaced toward each other and locked in place when the retention ring is rotated in a first direction.

6. An electrical connector assembly of claim 5, wherein the first and second electrical connectors are unlocked when the retention ring is rotated in a direction opposite the first direction.

7. An electrical connector assembly comprising:

a first electrical connector having a first housing coupled to a first set of electrical contacts, the first housing having one or more tabs extending radially away from the housing;

a second electrical connector having a second housing coupled to a second set of electrical contacts adapted to mate with the first set of electrical contacts, the second housing having a recessed groove formed on a generally cylindrical section; and, a retention ring having a first section configured for receiving the one or more tabs of the first connector and securing the tabs within the first section, and a second tubular section adapted to surround the generally cylindrical section of the second electrical connector, the second tubular section having a protrusion protruding inward on the inner surface of the second tubular section, the protrusion configured for slidably coupling within the recessed groove of the second electrical connector.

8. An electrical connector assembly of claim 7, wherein the first and second electrical connectors are displaced toward and locked in place with the other electrical connector when the retention ring is rotated in a first direction.

9. An electrical connector assembly of claim 7, wherein the first section further comprises a recessed track formed on the inner surface of the retention ring, wherein the recessed track is adapted for receiving and securing the tab of the first electrical connector when the retention ring is rotated in a first direction.

10. An electrical connector assembly of claim 7, wherein the recessed groove of the retention ring further comprises:

a locked region having a length essentially perpendicular to an insertion direction, the locked region located at a first distance from the outermost surface of the generally cylindrical section;

an unlocked region having a length essentially perpendicular to an insertion direction, the unlocked region located at a second distance from the outermost surface of the generally cylindrical section, the second distance differing from the first distance; and, an angled region providing a continuous path between the locked region and the unlocked region.

11. An electrical connector assembly of claim 7, wherein the first electrical connector comprises a male connector and the second electrical connector comprises a female connector.

12. An electrical connector assembly of claim 7, wherein the first electrical connector comprises a female connector and the second electrical connector comprises a male connector.

* * * * *